US007008507B2

(12) United States Patent
Urlaub et al.

(10) Patent No.: US 7,008,507 B2
(45) Date of Patent: Mar. 7, 2006

(54) NON-IMPACT PRINTING METHOD FOR APPLYING COMPOSITIONS TO WEBS AND PRODUCTS PRODUCED THEREFROM

(75) Inventors: John J. Urlaub, Oshkosh, WI (US); Thomas G. Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 191 days.

(21) Appl. No.: 10/335,138

(22) Filed: Dec. 31, 2002

(65) Prior Publication Data

US 2004/0131842 A1 Jul. 8, 2004

(51) Int. Cl.

| | |
|---|---|
| ***D21H 23/50*** | (2006.01) |
| ***D21H 23/22*** | (2006.01) |
| ***D21H 21/14*** | (2006.01) |
| ***D21H 21/22*** | (2006.01) |

(52) U.S. Cl. ..... 162/134; 162/135; 162/158; 162/109; 162/123; 162/172; 428/195.1; 428/340

(58) Field of Classification Search ..... 162/109, 162/111–113, 135–137, 183–185, 123, 158; 428/195.1, 156, 211, 153, 340

See application file for complete search history.

(56) References Cited

U.S. PATENT DOCUMENTS

| | | | | |
|---|---|---|---|---|
| 4,504,357 A | | 3/1985 | Holbein et al. | |
| 5,048,589 A | | 9/1991 | Cook et al. | |
| 5,129,988 A | | 7/1992 | Farrington, Jr. | |
| 5,399,412 A | | 3/1995 | Sudall et al. | |
| 5,405,678 A | * | 4/1995 | Bilodeau | 428/32.1 |
| 5,494,554 A | | 2/1996 | Edwards et al. | |
| 5,740,913 A | | 4/1998 | McFarland | |
| 5,851,651 A | * | 12/1998 | Chao | 428/327 |
| 5,935,381 A | | 8/1999 | Trokhan et al. | |
| 5,968,633 A | | 10/1999 | Hamilton et al. | |
| 6,040,014 A | * | 3/2000 | Izmirlian et al. | 427/358 |
| 6,096,412 A | | 8/2000 | McFarland et al. | |
| 6,099,940 A | | 8/2000 | Hamilton et al. | |
| 6,126,784 A | * | 10/2000 | Ficke et al. | 162/184 |
| 6,416,624 B1 | * | 7/2002 | Nielsen et al. | 162/155 |
| 6,450,633 B1 | * | 9/2002 | Kronzer | 347/105 |
| 6,551,455 B1 | * | 4/2003 | Johnson et al. | 162/128 |
| 6,630,055 B1 | * | 10/2003 | Goguelin et al. | 162/136 |

(Continued)

FOREIGN PATENT DOCUMENTS

EP 0213240 A1 3/1987

(Continued)

*Primary Examiner*—José A. Fortuna
(74) *Attorney, Agent, or Firm*—Dority & Manning, P.A.

(57) ABSTRACT

A method is disclosed for application of compositions onto non-woven webs, such as paper webs. The present invention is also directed to products made from the process. In general, the method includes applying a composition to a non-woven web using a non-impact printer, such as an ink jet printer. The composition is applied, in one embodiment, as droplets that remain as discrete shapes on the substrate. In this manner, treated areas and untreated areas are formed on the web. Through this process, the water absorption and control properties of the web can be adjusted as desired while simultaneously treating the web with a composition that improves the physical and/or chemical properties of the web.

24 Claims, 4 Drawing Sheets

U.S. PATENT DOCUMENTS

| | | | | |
|---|---|---|---|---|
| 6,733,773 | B1 * | 5/2004 | Hsu et al. | 424/443 |
| 2002/0112831 | A1 * | 8/2002 | Barnholtz et al. | 162/123 |
| 2002/0146548 | A1 * | 10/2002 | Forry et al. | 428/211 |
| 2004/0082668 | A1 * | 4/2004 | Vinson | 516/38 |
| 2004/0099388 | A1 * | 5/2004 | Chen et al. | 162/134 |
| 2004/0118531 | A1 * | 6/2004 | Shannon et al. | 162/109 |
| 2004/0131842 | A1 * | 7/2004 | Urlaub et al. | 428/327 |
| 2004/0163784 | A1 * | 8/2004 | Urlaub et al. | 162/135 |
| 2005/0058833 | A1 * | 3/2005 | Krzysik et al. | 428/375 |

FOREIGN PATENT DOCUMENTS

| | | | |
|---|---|---|---|
| EP | 1034928 | A2 | 9/2000 |
| EP | 1034928 | A3 | 9/2000 |
| EP | 1245396 | A2 | 10/2002 |
| EP | 1245396 | A3 | 10/2002 |
| WO | WO 0040505 | A1 | 7/2000 |

* cited by examiner

NON-IMPACT PRINTING METHOD FOR APPLYING COMPOSITIONS TO WEBS AND PRODUCTS PRODUCED THEREFROM

BACKGROUND OF THE INVENTION

Consumers use paper wiping products, such as facial tissues, paper towels, and bath tissues, for a wide variety of applications. Facial tissues are not only used for nose care but, in addition to other uses, can also be used as a general wiping product. Consequently, there are many different types of tissue products currently commercially available.

In some applications, tissue products are treated with polysiloxane lotions in order to increase the softness of the product. Adding silicone compositions to a tissue can impart improved softness to the tissue while maintaining the tissue's strength and while reducing the amount of lint produced by the tissue during use.

In the papermaking industry, various manufacturing techniques have been specifically designed to produce paper products which consumers find appealing. Manufacturers have employed various methods to apply chemical additives, such as silicone compositions, to the surface of a tissue web. Currently, one method of applying chemicals to the surface of a tissue web is the Rotogravure printing process. A Rotogravure printing process utilizes printing rollers to transfer chemicals onto a substrate. Chemical emulsions that are applied to webs using the Rotogravure printing process typically require the addition of water, surfactants, and/or solvents in order for the emulsions to be printed onto the substrate. Such additions are not only costly but also increase drying time and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical that is applied to a paper ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web.

Further, besides the above-mentioned difficulties in applying chemical additives to the surface of a paper web, some additives, such as softening agents, can also have a tendency to impart hydrophobicity to the treated paper web. Although hydrophobicity can be desirable in some applications, in other applications, increased hydrophobicity can adversely affect the product. For instance, increased hydrophobicity in a bath tissue can prevent the bath tissue from being wetted in a sufficient amount of time and prevent disintegration and dispersing when disposed in a commode or toilet. Hence, in some applications, it is difficult to find a proper balance between softness and absorbency, both of which are desirable attributes for many different types of tissue products.

Thus, a need also exists for a process of applying hydrophobic compositions to tissues for providing benefits to the tissue without increasing the hydrophibicity of the tissue beyond desirable limits.

SUMMARY OF THE INVENTION

In general, the present invention is directed to an improved process for applying compositions to paper webs, such as tissue webs. The present invention is also directed to improved paper products made from the process.

For example, in one embodiment, the present invention is directed to a process for applying an additive to a paper web, such as a tissue web, that includes the steps of providing a non-woven sheet and non-impact printing a composition onto at least one side of the sheet. The composition can be applied using, for instance, an ink jet printer. The ink jet printer can be, for example, a piezoelectric printer, a valve jet printer, or a thermal printer. The composition is deposited on the sheet in the form of discrete droplets. The droplets can have a diameter of less than about 3 mm. The composition can be applied to the sheet in a discontinuous manner such that the sheet includes treated areas where the droplets reside and untreated areas. The treated areas can comprise from about 5% to about 90% of the surface area of at least one side of the sheet.

The composition can generally be any material that provides benefits to paper webs. For instance, the composition can be a topical preparation that improves the physical properties of the web, that provides the web with antibacterial properties, that provides the web with medicinal properties, or that provides any other type of wellness benefits to a user of the paper web. For instance, the composition can contain an anti-acne agent, an anti-microbial agent, an anti-fungal agent, an antiseptic, an antioxidant, a cosmetic astringent, a drug astringent, an aiological agent, an emollient, an external analgesic, a humectant, a moisturizing agent, a skin conditioning agent, a skin exfoliating agent, a sunscreen agent, and mixtures thereof. In one embodiment, the composition is a softener. The softener can be, for instance, a polysiloxane.

The amount of the composition that is applied to the paper web depends on the particular application. For example, when applying a softener to a tissue web, the softener can be added in an amount from about 0.1% to about 10% by weight and particularly from about 0.1% to about 5% by weight, based upon the weight of the web.

The non-woven sheet treated in accordance with the present invention can be made from pulp and/or synthetic fibers. In one embodiment, for instance, the non-woven sheet is a paper web having a bulk of at least 2 $cm^3/g$. The paper web can be used to make, for instance, a facial tissue, a bath tissue or a paper towel. The non-woven sheet can be made from a single ply or can comprise multiple plies. When constructing a paper product, the non-woven sheet can generally have a basis weight, in one embodiment, of from about 10 gsm to about 80 gsm.

The droplets that are applied to the non-woven sheet using the non-impact printer can vary in size as desired. For example, in one embodiment, the droplets can have a diameter of less than about 200 microns, such as less than about 50 microns.

The process of the present invention provides great control over the amount of composition applied to the web and the placement of the composition on the web. It is believed that products made according to the process of the present invention have various unique characteristics. For instance, in one embodiment, a product made according to the present invention includes a paper web containing cellulosic fibers. The viscous composition containing a chemical additive is applied to at least one side of the paper web.

In particular, the composition can be applied in the form of discrete droplets forming treated areas on a sheet separated by untreated areas. Due to the presence of the untreated areas, a hydrophobic composition can be applied to the sheet without completely destroying the ability of the sheet to absorb water. For example, even after being treated with a hydrophobic composition, a paper sheet made according to the present invention can have a Wet Out Time of less than about 10 seconds, such as less than about 6 seconds.

In one embodiment, the non-impact printer that applies the composition to the non-woven sheet is digitally controlled by a controller. In this embodiment, the composition can be applied to the sheet according to a pattern that has been programmed into the controller.

In one particular embodiment, the non-woven web being treated can include a pattern that has been incorporated into the structure of the web. For instance, the web can include densified areas. According to the present invention, the controller used to control the non-impact printer can be configured to apply a composition to the sheet in a pattern that matches the pattern of the densified areas.

Various features and aspects of the present invention will be made apparent from the following detailed description.

BRIEF DESCRIPTION OF THE DRAWINGS

A full and enabling disclosure of this invention, is set forth in this specification. The following Figures illustrate the invention.

Figure 1:
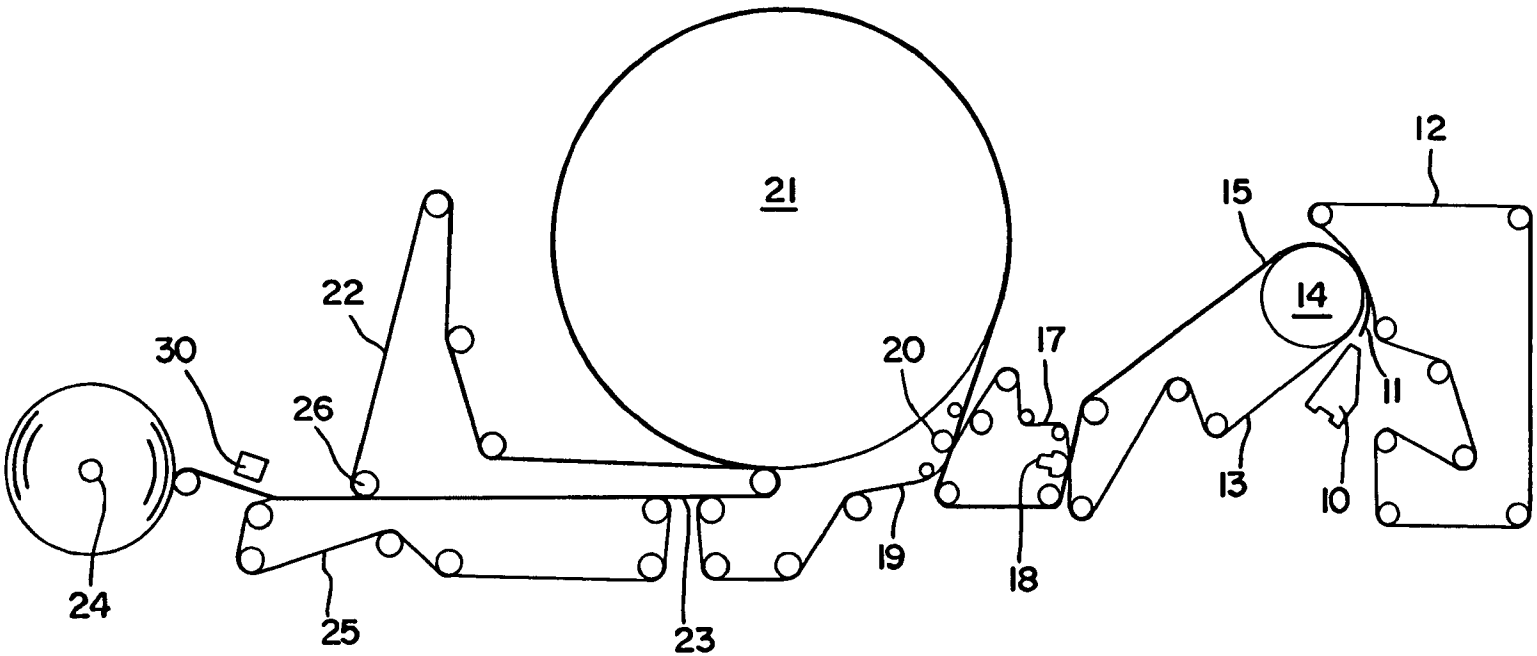
FIG. 1 is a schematic drawing of one embodiment of a process for producing paper webs in accordance with the present invention.

Repeated use of reference characters in the present specification and drawings is intended to represent the same or analogous features of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to applying chemical compositions onto non-woven webs, such as tissue and other paper webs. In accordance with the present invention, the composition is applied to the paper web using a non-impact printer, such as an ink jet printer. As used herein, a non-impact printer refers to a printer that applies a composition to a surface with a print head in which the print head itself does not contact the surface. The compositions that are applied to the paper products in accordance with the present invention include compositions that contain chemical additives that improve the physical and/or chemical properties of the product. For example, the composition can contain an additive that improves the feel of a paper product or, alternatively, an additive that is designed to be transferred to an adjacent surface or to a user during use of the product.

When used in accordance with the present invention for applying compositions to non-woven webs, non-impact printers have been found to provide various advantages and benefits, especially in comparison to the devices that have been used in the past to apply similar compositions to paper webs. For example, in comparison rotogravure printing processes and spray atomization processes, the process of the present invention provides more flexibility with respect to operation parameters. Further, it has been found that the process of the present invention provides better controls over flow rates and add-on levels of the compositions being applied to the webs. The process of the present invention is also better suited to preventing over-application of the composition and can provide better controls over placement of the composition onto the web.

Further, the present inventors have discovered that the non-impact printing process of the present invention is particularly well-suited to applying hydrophobic compositions, to paper webs. Specifically, in the past, hydrophobic compositions, such as polysiloxanes and other additives, were used sparingly in some applications due to their hydrophobicity. For instance, problems have been experienced in applying hydrophobic additives to tissue products due to the adverse impact upon the wettability of the product.

According to the present invention, however, hydrophobic compositions can be applied to non-woven webs as small, discrete drops. By applying the hydrophobic composition as discrete drops at particular areas on the web, it has been discovered that the compositions can be applied to the webs for improving the properties of the webs while maintaining acceptable wettability properties. As will be described in more detail below, in one embodiment of the present invention, for instance, a hydrophobic composition can be applied in a discrete or discontinuous manner to a paper web in order to maintain a proper balance between improving the properties of the web through the use of the composition and maintaining acceptable absorbency and wettability characteristics.

As described above, in one embodiment of the present invention, the non-impact printer used in the process of the present invention is an ink jet printer. Ink jet printers typically include an ink jet print head that has a plurality of orifices. A composition made according to the present invention may be expelled from one or more of these orifices thus exiting the print head of the ink jet printer. Drops of the composition then travel a throw distance between the print head and the non-woven web being treated. The orifices of the print head may be aligned in a single row or may be formed having various patterns. The composition may be expelled form these orifices either simultaneously or through selected orifices at any given time. For many applications, the throw distance from the print head to the surface onto which the composition is applied is typically less than about 15 mm, and is commonly less than about 5 mm.

According to the present invention, any suitable ink jet printing device can be used for applying compositions to non-woven webs, such as paper webs. Examples of ink jet printers that can be incorporated into the present invention, for instance, include thermal ink jet printers, piezoelectric printers, and valve jet printers.

Through the use of the above non-impact printers, a composition can be applied to a paper web in accordance with the present invention in a very controlled manner. Specifically, the non-impact printers of the present invention allow the composition to be applied to a non-woven web as discrete droplets. The size of the droplets can be varied as desired. Further, placement of the droplets on the non-woven web can be precisely controlled using a controller, such as a microprocessor or other type of programmable logic unit. Because the printers do not contact the non-woven web, the non-impact printers limit the spread of the composition once applied in the XY and Z directions and allow for the fine and discrete drops to remain intact on the sheet. Drop size and the pattern used to apply the composition can be varied to allow for optimal sensory properties on the sheet, such as softness, while still allowing for absorbency. Further, non-impact printers can also be adjusted in order to control the amount of surface penetration that occurs when the composition contacts the non-woven web. For example, in some applications, it is desired for the composition being applied to the non-woven web to remain on the surface and not migrate into the interior layers of the web.

In general, any flowable composition capable of being emitted by a non-impact printer can be applied to a non-woven web in accordance with the present invention. Possible ingredients or chemical additives that can be applied to non-woven webs include, without limitation, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. The above chemical additives can be applied alone or in combination with other additives in accordance with the present invention.

In one embodiment of the present invention, the composition contains a hydrophobic chemical additive. For example, the hydrophobic chemical additive can be a softener that is intended to be applied to a tissue product, such as a bath tissue, a facial tissue, or a paper towel. As described above, by applying a hydrophobic composition in a discontinuous manner through the use of a non-impact printer, a tissue product can be produced not only having a lotiony, soft feel, but also having good wettability even with the addition of the hydrophobic composition.

In one embodiment, the hydrophobic softener can be a polysiloxane. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries, Y-14128, Y-14344, Y-14461 and FTS-226 of the Witco Corporation, and Dow Corning 8620, Dow corning 2-8182 and Dow Corning 2-8194 of the Dow Corning Corporation.

In one particular embodiment of the present invention, the composition can contain a softener having the following chemical formula:

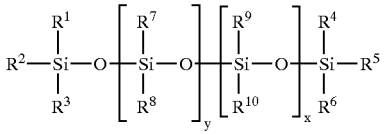

Wherein, x and y are integers such that at least one of x or y is >0. The mole ratio of x to (x+y) can be from about 0 percent to about 80 percent. The $R^1$–$R^{10}$ moieties can be independently any organofunctional group including $C_1$ or higher alkyl groups, ethers, polyethers, polyesters, amines, imines, amides, or other functional groups including the alkyl and alkyl analogues of such groups and including mixtures of said groups. A particularly useful moiety is a polyether functional group having the generic formula: $—R^{12}—(R^{13}—O)_a—(R^{14}O)_b—R^{15}$, wherein $R^{12}$, $R^{13}$, and $R^{14}$ are independently $C_{1—4}$ alkyl groups, linear or branched; $R^{15}$ can be H or a $C_{1-30}$ alkyl group; and, "a" and "b" are integers of from about 1 to about 100, more specifically from about 5 to about 30.

In one embodiment, the polysiloxane is an aminofunctional polysiloxane where the $R^{10}$ moiety includes a primary, secondary, tertiary or cationic amine group and the ratio of x to (x+y) is from about 0.005 percent to about 40 percent.

The temperature of the composition as it is applied to a paper web in accordance with the present invention can vary depending upon the particular application. For instance, in some applications, the composition can be applied at ambient temperatures. In other embodiments, however, the composition can be heated prior to or during application. The composition can be heated, for instance, in order to adjust the viscosity of the composition. The composition can be heated by a pre-heater prior to entering the printer or, alternatively, can be heated within the non-impact printer itself using, for instance, an electrical resistance heater.

In one embodiment, the composition containing the chemical additive can be a solid at ambient temperatures (from about 20° C. to about 23° C.). In this embodiment, the composition can be heated an amount sufficient to create a flowable liquid that can be emitted from a printing head. Once applied to a non-woven web, the composition can resolidify upon cooling.

Examples of additives that may need to be heated prior to being deposited on a paper web include compositions containing behenyl alcohol. Other compositions that may need to be heated include lotions, compositions that contain a wax, compositions that contain any type of polymer that is a solid at ambient temperatures, and/or compositions that contain a silicone.

In one exemplary embodiment of the present invention, the composition is a lotion. The lotion can be water-based or oil-based. Suitable water-based compositions include, but are not limited to, emulsions and water-dispersible compositions which can contain, for example, debonders (cationic, anionic or nonionic surfactants), or polyhydroxy compounds such as glycerin or propylene glycol.

Oil-based lotions can contain, for instance, a mixture of an oil and a wax. For example, the composition can contain from about 30% to about 90% by weight oil and from about 10% to about 40% by weight wax. In some embodiments, a fatty alcohol can also be included in an amount from about 5% to about 40% by weight.

Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, or silicone emulsions. For example, dimethicone and alkyl methyl silicones can be used.

Suitable waxes include, but are not limited to, the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax.

Suitable fatty alcohols include alcohols having a carbon chain length of from about 14 to about 30 carbon atoms, including acetyl alcohol, stearyl alcohol, behenyl alcohol, and dodecyl alcohol.

One particular embodiment of an oil-based lotion that may be applied in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above compositions can be heated to a temperature, for instance, from about 75° C. to about 150° C. during application. In some embodiments, the compositions rapidly solidify after deposition. Consequently, these compositions have less tendency to penetrate and migrate into the sheet being treated. Thus, a greater percentage of the lotion is left on the surface of the web where it can contact and/or transfer to the user's skin to provide a benefit.

The viscosity of the composition being applied to the non-woven web in accordance with the present invention will depend upon the particular non-impact printer being used and the desired results. For example, viscosity can be used to control migration of the composition. For many applications, when being applied to a non-woven web, the viscosity of the composition should be less than about 100 cp, such as less than about 50 cp. For example, in one embodiment, the viscosity can be less than about 25 cp.

The process of the present invention can be used to apply compositions and chemical additives to numerous and various different types of products. For example, in one embodiment, the present invention is directed to applying chemical additives to paper products, particularly tissue products. Such products can include bath tissues, facial tissues, paper towels, industrial wipers, and the like. The paper product can be a single ply product or, alternatively, a multi-ply product. For example, in one embodiment, the paper product is a three-ply facial tissue. The paper product can have a basis weight of from about, for instance, about 10 gsm to about 80 gsm. In general, bath tissues and facial tissues have a basis weight of less than about 50 gsm, while paper towels and industrial wipers typically have a basis weight of greater than about 30 gsm.

In addition to paper products, it is believed that various other non-woven webs can also be treated in accordance with the present invention. For example, polymeric non-woven webs, such as spunbond webs and meltblown webs can also be treated. Other non-woven webs include hydroknit webs, and coformed webs. Hydroknit and coformed webs can include a combination of both synthetic fibers and pulp fibers.

When treating a paper web in accordance with the present invention, the paper web can be made from any suitable paper making process and can contain various types of paper making fibers. Such fibers can include, for instance, any natural or synthetic cellulosic fibers including, but not limited, non-woody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood Kraft fibers; hardwood fibers, such as eucalyptus, maple, birch and aspen fibers. Woody fibers can be prepared in high-yield or low-yield forms and can be pulped in any known method. High-yield pulp fibers are those paper making fibers produced by pulping processes providing a yield of about 65% or greater, more specifically about 75% or greater and still more specifically about 75% to about 95%. Yield is the resulting amount of processed fibers expressed as a percentage of the initial wood mass. Such pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high-yield sulfite pulps, and high-yield Kraft pulps, all of which leave the resulting fibers with high levels of lignin.

The cellulosic fibers can also include paper broke or recycled fibers, mercerized fibers, regenerated cellulosic fibers, and the like.

A portion of the fiber furnish, such as up to about 50% or less by dry weight, such as from about 5% to about 30% by dry weight, can be synthetic fibers such as rayon fibers, polyolefin fibers, polyester fibers, bicomponent sheath-core fibers, multi-component binder fibers, and the like. Synthetic cellulose fibers include rayon fibers and other fibers derived from viscose or chemically modified cellulose.

In addition to various types of different fibers, paper webs made according to the present invention can also contain various fillers. Examples of fillers include clays, minerals, particulates, optical brighteners, and organic fillers.

Paper webs made in accordance with the present invention can be made with a homogeneous fiber furnish or can be formed from a stratified fiber furnish producing layers within a single ply. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers, such as eucalyptus fibers. The hardwood fibers can be mixed, if desired, with paper broke in an amount up to about 10% by weight and/or softwood fibers in an amount up to about 10% by weight. The base web further includes a middle layer positioned in between the first outer layer and the second outer layer. The middle layer can contain primarily softwood fibers. If desired other fibers, such as high-yield fibers or synthetic fibers may be mixed with the softwood fibers in an amount up to about 10% by weight.

When constructing a web from a stratified fiber furnish, the relative weight of each layer can vary depending upon the particular application. For example, in one embodiment, when constructing a web containing three layers, each layer can be from about 15% to about 40% of the total weight of the web, such as from about 25% to about 35% of the weight of the web.

As described above, the tissue product of the present invention can generally be formed by any of a variety of papermaking processes known in the art. In fact, any process capable of forming a paper web can be utilized in the present invention. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. No. 5,048,589 to Cook, et al.; U.S. Pat. No. 5,399,412 to Sudall et al.; U.S. Pat. No. 5,129,988 to Farrington, Jr.; U.S. Pat. No. 5,494,554 to Edwards et al.; which are incorporated herein in their entirety by reference thereto for all purposes. For most applications, paper webs made according to the present invention will have a bulk of about 2 $cm^3/g$ or greater.

For example, the web can contain pulp fibers and can be formed in a wet-lay process according to conventional paper making techniques. In a wet-lay process, the fiber furnish is combined with water to form an aqueous suspension. The aqueous suspension is spread onto a wire or felt and dried to form the web.

In one embodiment, the base web is formed by an uncreped through-air drying process. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry a newly-formed wet web 15 downstream in the process as the web is partially dewatered to a consistency of about 10 dry weight percent. Specifically, the suspension of fibers are deposited on the forming fabric 13 between a forming roll 14 and another dewatering fabric 12. Additional dewatering of the wet web 15 can be carried out, such as by vacuum suction, while the wet web is supported by the forming fabric.

The wet web 15 is then transferred from the forming fabric to a transfer fabric 17 traveling at a slower speed than the forming fabric in order to impart increased stretch into the web. Transfer is preferably carried out with the assistance of a vacuum shoe 18 and a fixed gap or space between the forming fabric and the transfer fabric or a kiss transfer to avoid compression of the wet web.

The web is then transferred from the transfer fabric to the throughdrying fabric 19 with the aid of a vacuum transfer roll 20 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

The level of vacuum used for the web transfers can be, for instance, from about 3 to about 15 inches of mercury (about 75 to about 380 millimeters of mercury), such as about 5 inches (about 125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

In accordance with one embodiment of the present invention, prior to being wound on the reel 24, the paper web 23 is treated with a composition that is emitted by a non-impact printer 30 such as an ink jet printer. As shown in FIG. 1, the non-impact printer 30 is positioned adjacent to the reel 24. In general, it is believed that a composition can be applied according to the present invention as long as the web 23 is at a consistency of about 70% or greater. Consequently, in addition to be placed adjacent to the reel 24, the non-impact printer 30 can also be placed at any other suitable location between the reel 24 and the dryer 21.

Figure 2:
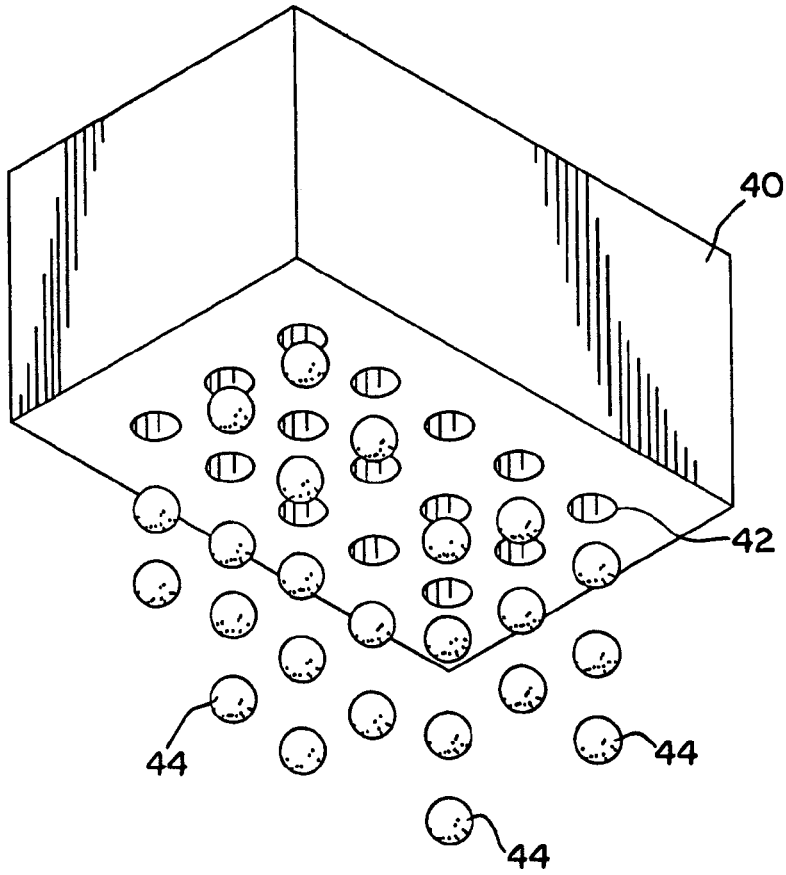
FIG. 2 is a perspective view of one embodiment of an ink jet printing head for use in the process of the present invention.

In one embodiment, the non-impact printer 30 will include a print head that traverses across the web and applies a composition according to the present invention. The composition is applied to the web in the form of small discrete droplets. For example, one embodiment of a print head 40 is shown in FIG. 2. As illustrated, a series of orifices 42 are present on the surface of the print head 40. As used in the art, the orifices 42 are sometimes referred in ink jet technology as being "jets". A composition 44 that affects the functional properties of a web being treated is dispensed through the orifices 42 of the print head 40. The composition 44 is shown in FIG. 2 as being dispensed through several but not all of the orifices 42. It should be understood, however, in other exemplary embodiments of the present invention, the composition 44 may be dispensed through any number or all of the orifices 42. In addition, the composition 44 may be dispensed in unequal amounts through different orifices 42.

The composition 44 is shown as being in the form of a series of drops. In other embodiments, the print head 40 or the composition can be modified such that the composition is dispensed as a steady stream or a configuration of drops which take various shapes.

When in the form of drops, the volume of the drops can vary depending upon the physical properties of the composition and the particular non-impact printer that is used. For example, when using a thermal ink jet printer or a piezoelectric ink jet printer, the drops can have a volume of from about 5 picoliters to about 500 picoliters and particularly from about 30 picoliters to about 200 picoliters. When using other printing devices, such as a valve jet printer, however, the size of the droplets can increase.

Figure 4:
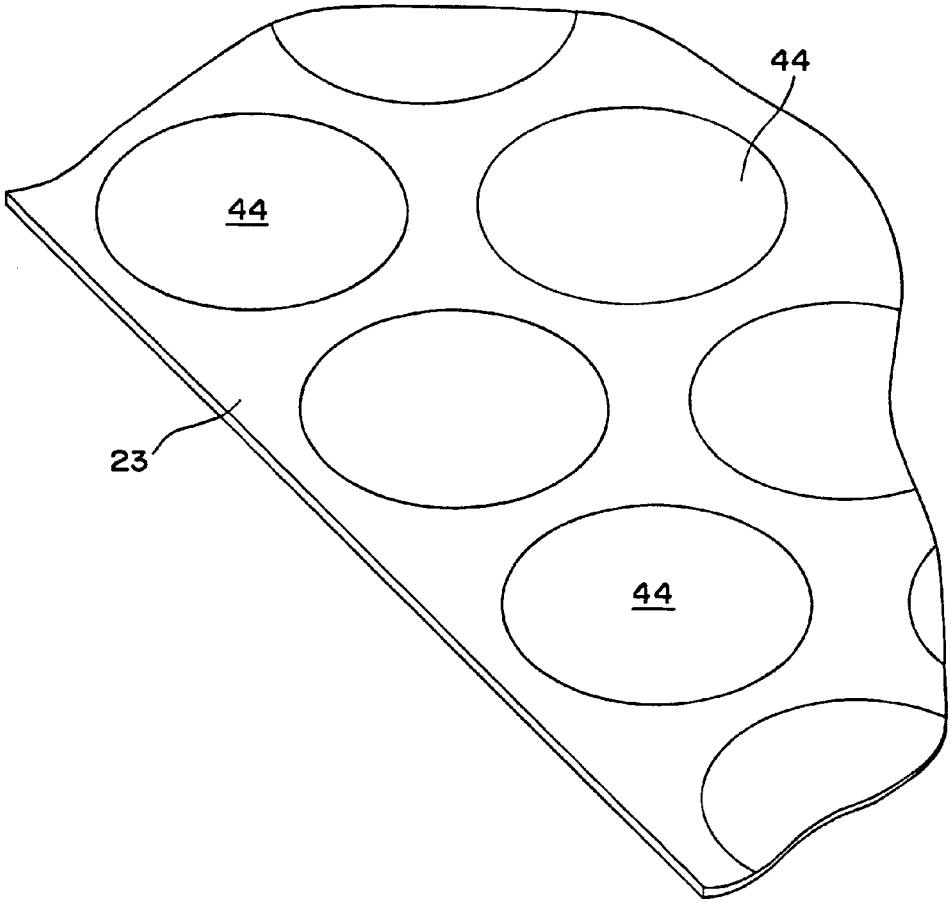
FIG. 4 is a perspective view of a non-woven web, such as a paper web, treated in accordance with the present invention.

Referring to FIG. 4, one exemplary embodiment of a paper product treated in accordance with the present invention is shown. As illustrated, the paper product includes a paper web 23 treated with a composition 44 in the form of discrete shapes, such as circles. As shown, in this embodiment, each droplet is spaced apart from adjacent droplets. In alternative embodiments, however, the droplets can overlap.

The diameter of the discrete shapes located on the paper web 23 can vary depending upon the particular application. For many applications, the diameter of the discrete shapes can be up to about 3 mm. For instance, the discrete shapes can have a diameter of from about 1 mm to about 2 mm when a valve jet printer is used. When using other types of printers, however, the diameter of the discrete shapes can be less than about 200 microns, such as less than 100 microns or less than 50 microns. For example, in one particular embodiment, the discrete shapes can have a diameter of less than about 10 microns.

The amount and location of the discrete shapes formed from the composition can vary depending upon the particular application. Of particular advantage, many non-impact printers allow for controlled deposition of the composition. In general, the composition is applied to the non-woven web so as to cover from about 5% to about 99% of the surface area of one side of the web. For instance, the composition can cover from about 5% to about 60% of the surface area of one side of the web, and more particularly can cover from about 30% to about 60% of the surface area of one side of the web.

The composition can also be applied such that the density of the discrete areas can be varied and controlled. In general, the density of the discrete areas in any given direction on the web will depend upon the diameter of the areas, the physical properties of the composition and the desired result. In one embodiment, it may be desired to have a relatively high density of discrete shapes.

The add-on rate of the composition can also vary depending upon the particular application. For instance, the add-on rate can be such that the composition is applied to the non-woven web in an amount from about 0.1% to about 10% by weight or greater.

In the embodiment illustrated in FIG. 1, the non-impact printer 30 is shown incorporated directly into the paper making process line. Alternatively, however, the non-woven web can be treated with a composition using a non-impact printer on a converting line after formation of the non-woven web. For instance, FIG. 3 illustrates another embodiment of a process for treating a formed web with a composition in accordance with the present invention.

Figure 3:
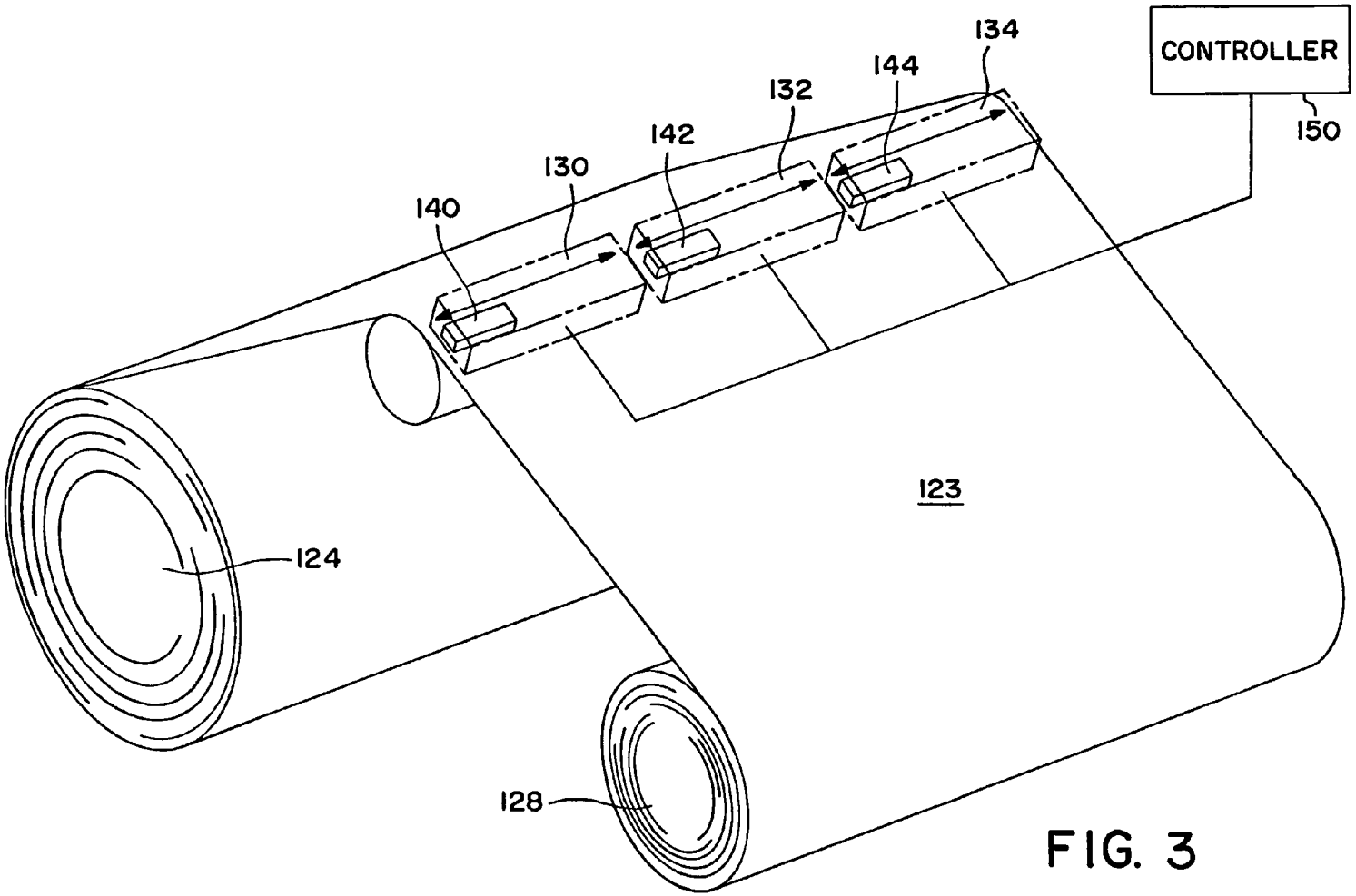
FIG. 3 is a perspective view of one embodiment for applying compositions to non-woven webs in accordance with the present invention.

As shown in FIG. 3, a paper web 123 is unwound from a supply roll 124 and rewound into a roll 128. During the rewinding operation, the paper web 123 is treated with a composition using, in this embodiment, three non-impact printers 130, 132 and 134 spaced across the web in the cross-machine direction. As shown, each non-impact printer 130, 132 and 134 includes a respective printing head 140, 142 and 144 that moves across a portion of the paper web 123 and deposits a composition in discrete droplets. Depending upon the non-impact printer used, a greater or lesser number of printing devices and/or print heads may be used in the present invention.

As described above, the non-impact printers, which can be ink jet printers, are capable of applying a composition to a paper web in a controlled manner. The composition is applied to the web as discrete droplets that provide the web with treated areas and untreated areas. As shown in FIG. 3, each of the non-impact printers can be placed in communication with a controller 150. The controller 150 can be, for instance, a microprocessor, a computer, or any other suitable programmable logic unit.

In one embodiment, the controller 150 can be configured to store programs that are designed to control the amount of composition applied to the paper web 123. For instance, one or more patterns can be stored in the controller 150. The composition can be applied to the paper web 123 using the non-impact printers 130, 132 and 134 according to the stored pattern.

When using a controller 150 in conjunction with the non-impact printers, various advantages and benefits are realized. For instance, since the non-impact printers can be digitally controlled, designs or patters being printed onto the non-woven webs can be instantaneously adjusted as desired. The non-impact printers in conjunction with a controller can also store a limitless number of designs and can be switched between designs easily and almost instantaneously. Further, designs can be created and used very rapidly. When changing patterns, drop size can be changed, the amount of surface area coverage can be changed, and the add-on rate of the composition can also be varied.

In view of the flexibility provided by the above-described printing system, the present invention further provides the opportunities to make and create unique and novel products. For instance, in one embodiment, the formed paper web 123 can include a pattern that is incorporated into the structure of the web. For example, the web can include a pattern of high density and low density areas and/or a pattern of high basis weight and low basis weight areas. The pattern can be formed into the web using various processes and techniques. For instance, the pattern incorporated into the web can be formed through embossing. Alternatively, a pattern can be formed in the web during through-air drying by using a through-air drying fabric having a three dimensional surface that becomes superimposed on the web as disclosed in, for instance, U.S. Pat. No. 5,129,988 to Farrington, Jr., which is incorporated herein by reference. A densified pattern can also be formed in the web according to the process disclosed in U.S. Pat. No. 5,935,381 to Trokhan, which is also incorporated herein by reference.

Once a pattern is incorporated into the web, the non-impact printer of the present invention can then be used to apply a composition to the web according to a separate and distinct pattern. The pattern by which the composition is applied can match or otherwise be placed in synchronicity with the pattern that was incorporated into the web during its formation. For instance, the formed paper web can be fed into the non-impact printing device and the printed pattern of the composition can be cued to begin at a particular point in the pattern that has been physically incorporated into the web. To maintain a match between the physical pattern and the printed pattern, the treated web can be monitored. As explained above, through the use of a controller, the printed pattern being applied by the non-impact printing device can be adjusted and varied quickly and easily for maintaining the patterns in alignment.

In one particular embodiment, for instance, the tissue web can include a physical pattern of peaks and valleys. The composition of the present invention can be applied to the paper web in a manner such that the composition only is applied to the valley areas or is only applied to the peak areas as desired. Through this process, the composition can be applied to the web at strategic locations for maximizing its use, while also optimizing the water absorbency properties of the web.

One test that measures the wettability of a web is referred to as the "Wet Out Time" test. The Wet Out Time of paper webs treated in accordance with the present invention can be about 10 seconds or less, and more specifically about 8 seconds or less. For instance, paper webs treated in accordance with the present invention can have a Wet Out Time of about 10 seconds or less, still more specifically about 5 seconds or less, still more specifically from about 4 to about 6 seconds.

As used herein, "Wet Out time" is related to absorbency and is the time it takes for a given sample to completely wet out when placed in water. More specifically, the Wet Out Time is determined by cutting 20 sheets of the tissue sample into 2.5 inch squares. The number of sheets used in the test is independent of the number of plies per sheet of product. The 20 square sheets are stacked together and stapled at each corner to form a pad. The pad is held close to the surface of a constant temperature distilled water bath (23+/−2° C.), which is the appropriate size and depth to ensure the saturated specimen does not contact the bottom of the container and the top surface of the water at the same time, and dropped flat onto the water surface, staple points down. The time taken for the pad to become completely saturated, measured in seconds, is the Wet Out Time for the sample and represents the absorbent rate of the tissue. Increases in the Wet Out Time represent a decrease in the absorbent rate.

In addition to producing paper webs having good wettability characteristics, the process of the present invention has been also found to improve other water retention and absorbency properties of the web. For example, it has been discovered by the present inventors that when using a non-impact printing device in accordance with the present invention, in one embodiment, the composition can be applied so as to remain primarily on the outer surface of the paper web without migrating into the interior. This construction is particularly useful when applying compositions to multiply products. For instance, when applying a composition to a three-ply product, it has been discovered that the composition can be applied such that there is little or no migration of the composition to the middle ply. Consequently, although the water absorption properties of the outer plies may be reduced, the water absorption properties of the inner ply remain substantially unchanged. Ultimately, a paper product can be treated with a hydrophobic composition in accordance with the present invention and can remain water absorbable due to the untreated areas present on the outside surface of the product, remain water absorbable in the middle of the product, and have good liquid retention properties, since the composition applied to the web tends to act as a liquid barrier coating.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A process for applying a composition onto a nonwoven web comprising:

providing a nonwoven sheet, the nonwoven sheet comprising a paper web containing cellulosic fibers; and non-impact printing a composition onto at least one side of the sheet using an ink jet printer, the composition being applied in an amount sufficient to improve the physical properties of the sheet or to be transferred to an adjacent surface during use of the sheet, the composition being deposited on the sheet in the form of discrete droplets, the droplets on the sheet having a diameter of less than about 3 mm, the composition being applied to the sheet in a discontinuous manner such that the sheet includes treated areas where the droplets reside and untreated areas, the treated areas comprising from about 5% to about 90% of the surface area of the at least one side, wherein the paper web after being printed with the composition has a wet out time of less than about 10 seconds.

2. The process as defined in claim 1, wherein the composition is hydrophobic.

3. The process as defined in claim 2, wherein the composition comprises a silicone.

4. The process as defined in claim 3, wherein the silicone comprises:

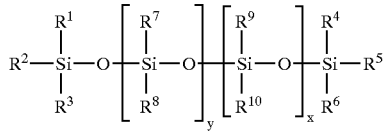

wherein, x and y are integers such that at least one of x or y is >0, the mole ratio of x to (x+y) can be from about 0 percent to about 80 percent, and the $R^1$–$R^{10}$ moieties can be independently any organofunctional group including $C_1$ or higher alkyl groups, ethers, polyethers, polyesters, amines, imines, amides, or other functional groups including the alkyl and alkyl analogues of such groups and including mixtures of said groups. composition is hydrophobic.

5. The process as defined in claim 1, wherein the ink jet printer is a piezoelectric printer, a valvejet printer, or a thermal printer.

6. The process as defined in claim 1, wherein the nonwoven sheet comprises multiple plies.

7. The process as defined in claim 1, wherein the droplets have a diameter of less than about 200 microns.

8. The process as defined in claim 1, wherein the droplets have a diameter of less than about 50 microns.

9. The process as defined in claim 1, wherein the treated areas comprise from about 5% to about 60% of the surface area of the at least one side of the sheet.

10. The process as defined in claim 1, wherein the nonwoven sheet comprises a bath tissue, a facial tissue, or a paper towel.

11. The process as defined in claim 1, wherein the paper web has a basis weight of from about 10 gsm to about 80 gsm.

12. The process as defined in claim 1, wherein the composition comprises a wax that is solid at room temperature and wherein the process further comprises the step of heating the composition prior to applying the composition to the sheet.

13. The process as defined in claim 1, wherein the composition is applied to the sheet at an add on rate of from about 0.1% to about 10% by weight of the sheet.

14. A process for applying a composition onto a paper web comprising the steps of:

providing a paper sheet containing cellulosic fibers, the sheet having a basis weight of from about 10 gsm to about 80 gsm and having a bulk of at least about 2 $cm^3/g$; and non-impact printing a composition onto at least one side of the sheet using an ink jet printer, the composition being deposited on the sheet in the form of discrete droplets, the droplets on the sheet having a diameter of less than about 3 mm, the composition being applied to the sheet in a discontinuous manner such that the sheet includes treated areas where the droplets reside and untreated areas, the treated areas comprising from about 5% to about 90% of the surface area of the at least one side, the composition being applied to the sheet at an add on rate of from about 0.1% to about 10% by weight of the sheet, the paper sheet after being treated with the composition having a wet out time of less than about 10 seconds.

15. The process as defined in claim 14, wherein the composition comprises a silicone.

16. The process as defined in claim 14, wherein the droplets have a diameter on the sheet of less than about 50 microns.

17. The process as defined in claim 14, wherein the composition comprises a wax.

18. The process as defined in claim 14, wherein the paper sheet includes multiple plies.

19. The process as defined in claim 14, wherein the composition is applied to the sheet while the sheet is moving using a plurality of ink jet printers.

20. The process as defined in claim 14, wherein the ink jet printer is digitally controlled by a controller, the composition being applied to the sheet according to a pattern that has been programmed into the controller.

21. The process as defined in claim 20, wherein the paper sheet includes a pattern of areas where the sheet has been densified, said controller being configured to apply the composition to the sheet in a pattern that matches the pattern of the densified areas.

22. The process as defined in claim 14 wherein the droplets prior to contacting the sheet have a volume of from about 5 picoliters to about 500 picoliters.

23. The process as defined in claim 14, wherein the droplets are uniformly applied over the surface of the sheet.

24. A paper product comprising:

a paper sheet comprising pulp fibers, the paper sheet having a basis weight of from about 10 gsm to about 80 gsm and having a bulk of at least about 10 cc per gram; and a composition applied to at least one side of the paper sheet, the composition comprising a chemical additive, the composition being applied to the sheet in the form of discrete droplets, the droplets forming treated areas on the sheet separated by untreated areas, the droplets on the sheet having a diameter of less than about 200 microns, the treated areas comprising from about 5% to about 90% of the surface area of the at least one side of the sheet, the composition being hydrophobic, the sheet after being treated with the composition having a wet out time of less than about 10 seconds.

* * * * *

UNITED STATES PATENT AND TRADEMARK OFFICE

CERTIFICATE OF CORRECTION

PATENT NO. : 7,008,507 B2
APPLICATION NO. : 10/335138
DATED : March 7, 2006
INVENTOR(S) : John J. Urlaub and Thomas G. Shannon It is certified that error appears in the above-identified patent and that said Letters Patent is hereby corrected as shown below:

Column 14, line 35 (Claim 4) "composition is hydrophobic." should be deleted. Line should read --mixtures of said groups.--

Signed and Sealed this

Twenty-second Day of August, 2006

JON W. DUDAS
*Director of the United States Patent and Trademark Office*